US006557982B2

(12) United States Patent
Murakami et al.

(10) Patent No.: US 6,557,982 B2
(45) Date of Patent: May 6, 2003

(54) INK JET RECORDING METHOD AND APPARATUS FOR DRIVING ELECTROTHERMAL CONVERTING ELEMENTS IN A DISPERSED MANNER

(75) Inventors: Shuichi Murakami, Kanagawa (JP); Hiroshi Tajika, Kanagawa (JP); Michinari Mizutani, Kanagawa (JP); Norihiro Kawatoko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,011

(22) Filed: Jul. 9, 2001

(65) Prior Publication Data

US 2002/0036676 A1 Mar. 28, 2002

(30) Foreign Application Priority Data

Jul. 10, 2000 (JP) ..... 2000-209029

(51) Int. Cl.[7] ..... B41J 2/05
(52) U.S. Cl. ..... 347/56; 347/65
(58) Field of Search ..... 347/9, 12, 13, 347/40, 56, 57, 42, 58, 59

(56) References Cited

U.S. PATENT DOCUMENTS 4,683,481 A 7/1987 Johnson ..... 347/65
5,173,717 A * 12/1992 Kishida et al. ..... 347/56
5,594,481 A * 1/1997 Keefe et al. ..... 347/65
5,729,257 A * 3/1998 Sekiya et al. ..... 347/9
5,754,193 A * 5/1998 Elhaten ..... 347/12
6,143,190 A 11/2000 Yagi et al. ..... 219/27
6,280,020 B1 8/2001 Tachihara et al. ..... 347/65

FOREIGN PATENT DOCUMENTS

JP 10-181032 * 7/1998 ..... B41J/2/16

* cited by examiner

*Primary Examiner*—Craig Hallacher
*Assistant Examiner*—Juanita Stephens
(74) *Attorney, Agent, or Firm*—Fitzpartick, Cella, Harper & Scinto

(57) ABSTRACT

By using an ink jet recording head including an ink supply port for supplying an ink, a plurality of ink paths communicating with the ink supply port, a plurality of electro thermal converting elements arranged in an almost straight line along the longitudinal direction of the ink supply port which are disposed respectively in the plurality of ink paths and generate thermal energies utilized for discharging the ink, and a plurality of discharge ports for discharging the ink which communicate with the plurality of ink paths, respectively and are disposed by respectively facing the plurality of electro thermal converting elements, a recording is performed by disperse-driving the plurality of electro thermal converting elements.

20 Claims, 16 Drawing Sheets

INK JET RECORDING METHOD AND APPARATUS FOR DRIVING ELECTROTHERMAL CONVERTING ELEMENTS IN A DISPERSED MANNER

BACKGROUND OF THE INVENTION

1. Field of the Invention

The present invention relates to an ink jet recording method and an ink jet recording apparatus performing a recording operation by discharging a liquid such as an ink.

2. Related Background Art

For an ink discharging method of a conventional ink jet recording system in use today, there exists a method of discharging an ink droplet utilizing an electro thermal converting element (heater) as a discharge energy element and a method of discharging an ink droplet utilizing a piezoelectric (piezo) element, either of which is capable of controlling the discharge of the ink droplet by an electric signal. For example, one feature of the ink droplet discharge method using the electro thermal converting element is that, by giving the electric signal to the electro thermal converting element, the ink in the vicinity of the electro thermal converting element is instantaneously boiled, and by an abrupt growth of a bubble produced by a phase change of the ink on that occasion, the ink droplet is discharged at high speed. On the other hand, a feature of the discharge method of the ink droplet utilizing the piezoelectric element is that, by giving the electric signal to the piezoelectric element, the piezoelectric element is displaced and, by a pressure caused at the displacement time, the ink droplet is discharged. The former method has the advantages that it does not require undue space for the discharge energy generation element, the constitution of an ink jet recording head is simple, and an integration of nozzles is easy. On the other hand, this method has disadvantages such as a volume fluctuation of a flying ink droplet caused by a heat storage in the ink jet recording head of heat generated by the electro thermal converting element, and an influence exerted on the electro thermal converting element by a cavitation due to a bubble extinction.

In the ink jet recording head where a plurality of energy generation elements are formed, energy is not normally applied simultaneously to all of a plurality of energy generation elements. As a practical matter, when the electric signal is given simultaneously to the eletro thermal converting elements, because the electric current simultaneously flowing is increased, an electric power source capable of supplying a large electric current is required and the efficiency becomes poor. Further, because a voltage drop occurs in the wiring between the power source and the electro thermal converting element, the efficiency is lowered. Hence, a plurality of electro thermal converting elements are driven by being subjected to a time division.

In the ink jet recording head of a so-called edge shooter type ink does not discharge almost vertically from a discharge port facing the electro thermal converting element. Instead, the ink discharges in the direction having a certain angle (acute angle) including 0°. Because the discharge ports are arranged in a straight line, the displacement position of dots has often deviated when the time division driving was performed. For this reason, a row of discharge ports was arranged obliquely at a certain angle so that the displacement dots were made straight in a line. However, when a block driving was performed, because another block performing the discharge subsequently to the block which has finished the discharge was in the vicinity, a displacement deviation of dots was easy to observe visually.

On the other hand, in the ink jet recording head of a so-called side shooter type which discharges almost vertically from the discharge port facing the electro thermal converting element, the position of electro thermal converting elements 414 arranged on both sides of an ink supply port 415 and the position of the discharge ports are deviated only by the displacement deviation produced when the time division driving was performed as shown in FIG. 19 so that the displacement dots were made into a line. For example, in the ink jet recording head as shown in FIG. 19, and also as shown in Table 1 and Table 2, the electro thermal converting element 414 was allowed to carry a deviation of the maximum 18 $\mu$m, that is, equivalent to 1200 DPI as a deviation in the X direction.

TABLE 1

| Segment | Deviation in X direction |
|---|---|
| 0 | 0 |
| 2 | 1 |
| 4 | 7 |
| 6 | 8.5 |
| 8 | 14.5 |
| 10 | 15.5 |
| 12 | 2.5 |
| 14 | 3.5 |
| 16 | 9.5 |
| 18 | 11 |
| 20 | 17 |
| 22 | 18 |
| 24 | 4.5 |
| 26 | 6 |
| 28 | 12 |
| 30 | 13.5 |

(Even number segments are a repetition of the above described sequence in the following segments.)

TABLE 2

| Segment | Deviation in X direction |
|---|---|
| 1 | 0 |
| 3 | 1 |
| 5 | 7 |
| 7 | 8.5 |
| 9 | 14.5 |
| 11 | 15.5 |
| 13 | 2.5 |
| 15 | 3.5 |
| 17 | 9.5 |
| 19 | 11 |
| 21 | 17 |
| 23 | 18 |
| 25 | 4.5 |
| 27 | 6 |
| 29 | 12 |
| 31 | 13.5 |

(Odd number segments are a repetition of the above described sequence in the following segments.)

However, in the conventional ink jet recording head of the side shooter type, because the position of the electro thermal converting element is deviated, in the discharge port where the distance from the ink supply port for supplying the ink to the inside of the nozzle to the electro thermal converting element is relatively long, the time for refilling (refill) after discharging the ink is required much more and thus a high speed response has been degraded. By allowing the discharge to be performed at the timing which is not in time for refilling, a discharge defect was caused or a discharge amount was lowered.

Also, the longer the distance from the ink supply port to the electro thermal converting element, the greater the inertial resistance in the initial stage of energization of the electro thermal converting element and bubbling at the ink supply port side, and therefore a bubbling tends to grow at the discharge port side. For this reason, the ink discharge amount becomes larger than the amount discharged from the discharge port where the distance from the ink supply port to the electro thermal converting element is short and tends to be uneven, and the problem often arises that, because a discharge speed becomes relatively high, the displacement deviation cannot be accurately corrected.

Further, because a wiring resistance between the electro thermal converting element and a driving element depends on the distance from the ink supply port to the electro thermal converting element, the wiring resistance does not become uniform and an irregularity is caused to the energy required until the bubbling arises between the electro thermal converting elements. Thus, there was often the case where the energy is supplied enough for the electro thermal converting element which requires the energy most and a durability of the electro thermal converting element is lowered.

Further, in the ink jet recording head, due to evaporation of the ink from the discharge port, when the discharge starts from a non-recording state, there occurs a phenomenon referred to as a viscous plug property which leads to the discharge defect such as the non-discharge, a diminished dot where the discharge amount becomes small and the like. The viscous plug property tends to become worse for the discharge port having a long distance from the ink supply port to the electro thermal converting element as it is hard to get an ink supply when the evaporation of the ink further advances and, in particular, the smaller the liquid droplet became, the more marked influence it received. Further, particularly for the discharge port which is separated from the adjacent discharge port by deviating the position of the electro thermal converting element and the discharge port for correcting the displacement deviation, a control effect of the evaporation by the evaporation atmosphere from the discharge port was lowered, and the viscous plug property was easy to occur. In this connection, the ink evaporates from the discharge port and the density of the ink in the discharge port is raised with the result that the density of the discharged displacement dot sometimes becomes high. In the head of the side shooter type where the disposed position of the discharge port is deviated as described above and the interval between the ink supply port and the electro thermal converting element is different for each discharge port, an ink supply capacity from the ink supply port is different for each discharge port, and therefore, the density of the displacement dot is different for each discharge port and the lowering of a recording quality was sometimes caused. This problem becomes more marked as the liquid droplet size becomes smaller and the interval between the discharge port and the electro thermal converting element becomes smaller (the system where the bubble formed by the electro thermal converting element communicates with the atmosphere).

SUMMARY OF THE INVENTION

The present inventors have recognized that, rather than the technical problem (hereinafter referred to as "a first technical problem") attributable to the deviation in the displacement dot by the time division driving of the electro thermal converting element arranged in a straight line as the ink discharge liquid droplet amount becomes equal to or smaller than 9 pl and further smaller than 5 pl and/or the density of the electro thermal converting elements arranged in the shape of a column becomes equal to or more than 600 DPI, the above described technical problem (hereinafter referred to as "a second technical problem") attributable to the unbalance caused as a result of the fact that the distance from the ink supply port to the electro thermal converting element is allowed to be different from each electro thermal converting element so as to solve the above-described deviation has manifested itself, and this led us to make the present invention. In other words, the present invention was made as a result of attempting an optimization to solve the first technical problem and the second technical problem from an overall viewpoint.

One of the objects of the present invention is to provide the ink jet recording method and the ink jet recording apparatus wherein a driving frequency characteristic has improved.

Another object of the present invention is to provide the ink jet recording method and the ink jet recording apparatus wherein recording irregularities have been reduced and a recording quality has improved.

Still another object of the present invention is to provide the ink jet recording method and the ink jet recording apparatus wherein durability and reliability of the head has improved.

Still another object of the present invention is to provide the ink jet recording method and the ink jet recording apparatus wherein viscous plug properties have improved.

Still another object of the present invention is to provide the ink jet recording method, wherein, by using the ink jet recording head comprising the ink supply port for supplying the ink, a plurality of ink paths communicating with the ink supply port, a plurality of electro thermal converting elements arranged in an almost straight line along the longitudinal direction of the above described ink supply port which are disposed respectively inside said plurality of ink paths and generate a thermal energy to be utilized for discharging the ink and a plurality of discharge ports for discharging the ink which communicate with the above described plurality of ink paths respectively and are disposed by respectively facing the above described plurality of electro thermal converting elements, a recording is performed by disperse-driving the above described plurality of electro thermal converting elements.

Still another object of the present invention is to provide the ink jet recording apparatus, comprising the ink jet recording head which comprises: the ink supply port for supplying the ink; a plurality of ink paths communicating with the ink supply port; a plurality of electro thermal converting elements arranged in an almost straight line along the longitudinal direction of the above described ink supply port which are disposed respectively inside the above described plurality of ink paths and generate thermal energies to be utilized for discharging the ink; a plurality of discharge ports for discharging the ink which communicate with the above described plurality of ink paths respectively and are disposed by respectively facing the above described plurality of electro thermal converting elements; and a control portion for disperse-driving the above described plurality of electro thermal converting elements.

According to the present invention, an overall performance such as the driving frequency characteristic, the recording quality, the durability of the head and the viscous plug properties can be rapidly improved.

DETAILED DESCRIPTION OF THE PREFERRED EMBODIMENTS

Next, the embodiments of the present invention will be described with reference to the drawings. What is meant here in the present specification by "driving a discharge port(s)" or "driving an electro thermal converting element(s)" is that a bubble is formed in an ink by heating the electro thermal converting element disposed in correspondence with a discharge port and the ink is discharged from the discharge port. Also, what is meant by "a block driving" is that a group of discharge ports physically adjacent are simultaneously driven and each group is subsequently driven. What is meant by "a subsequent disperse driving" is that a group of discharge ports physically adjacent are subsequently driven and each group is driven by synchronizing with each other. What is meant by a simple "disperse driving" is that the discharge ports physically adjacent with one another are driven as a different block and the discharge ports physically adjacent are not subsequently driven.

First Embodiment

Figure 1:
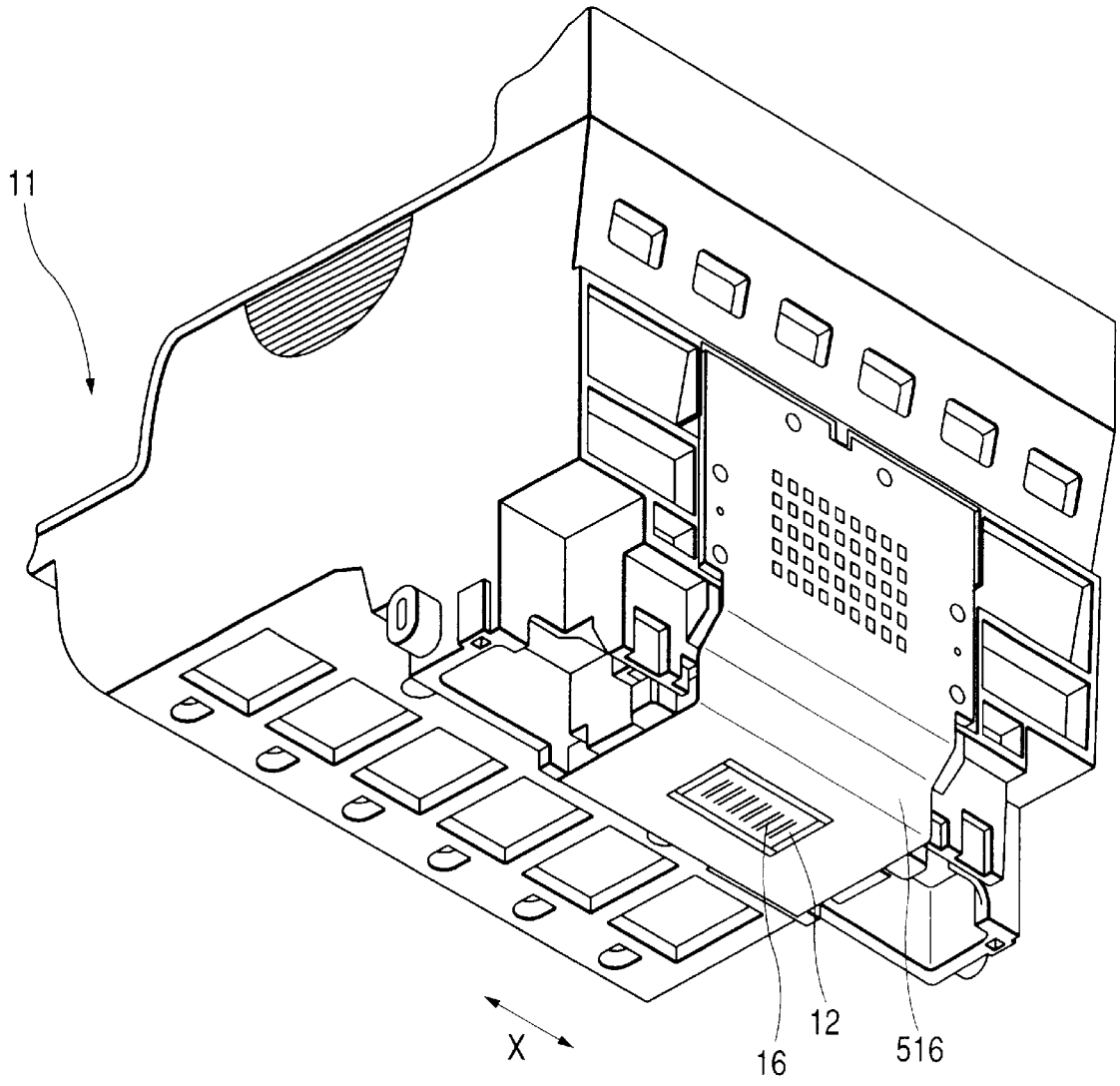
FIG. 1 is an outside perspective view of an ink jet recording head in a first embodiment of the present invention.
Figure 2:
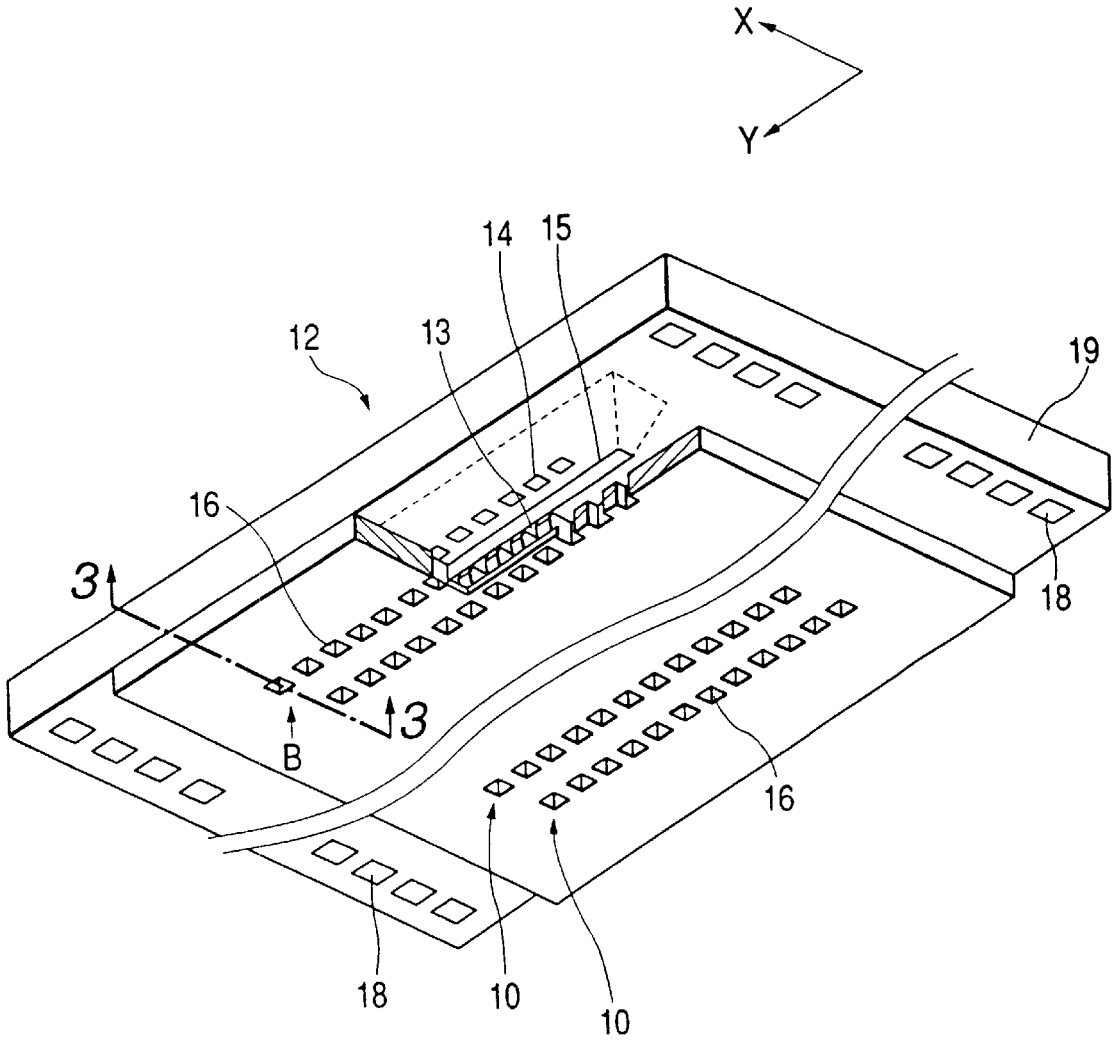
FIG. 2 is a partially broken perspective view of a recording element substrate provided for the ink jet recording head as shown in FIG. 1.
Figure 3:
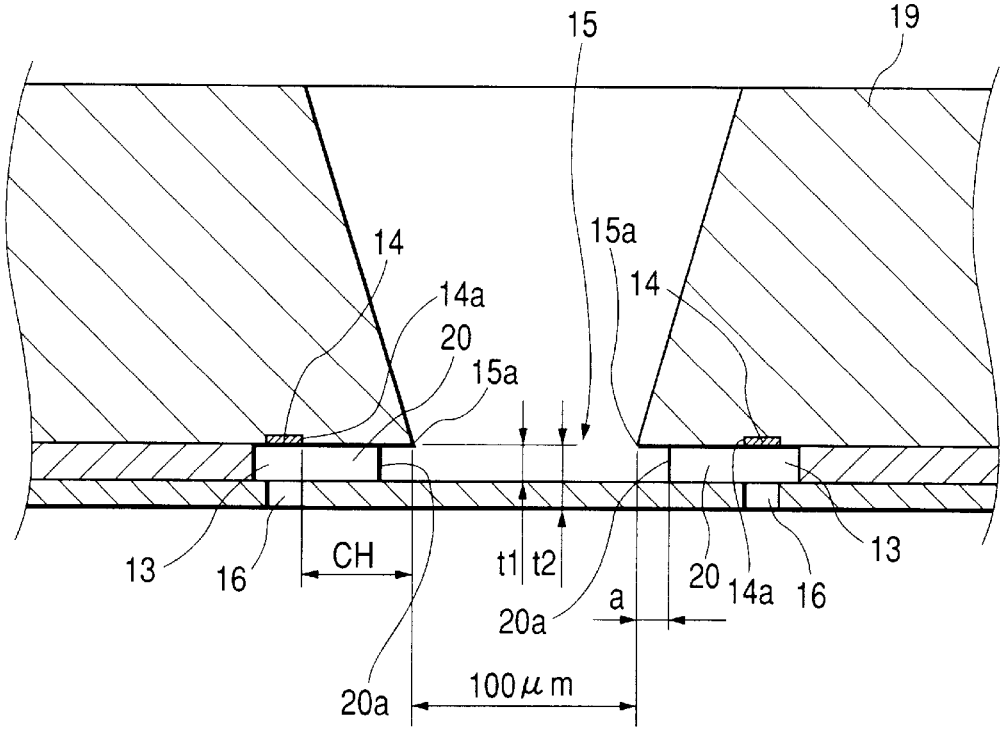
FIG. 3 is a partial sectional view of the recording element substrate taken along the line 3—3 in FIG. 2.
Figure 4:
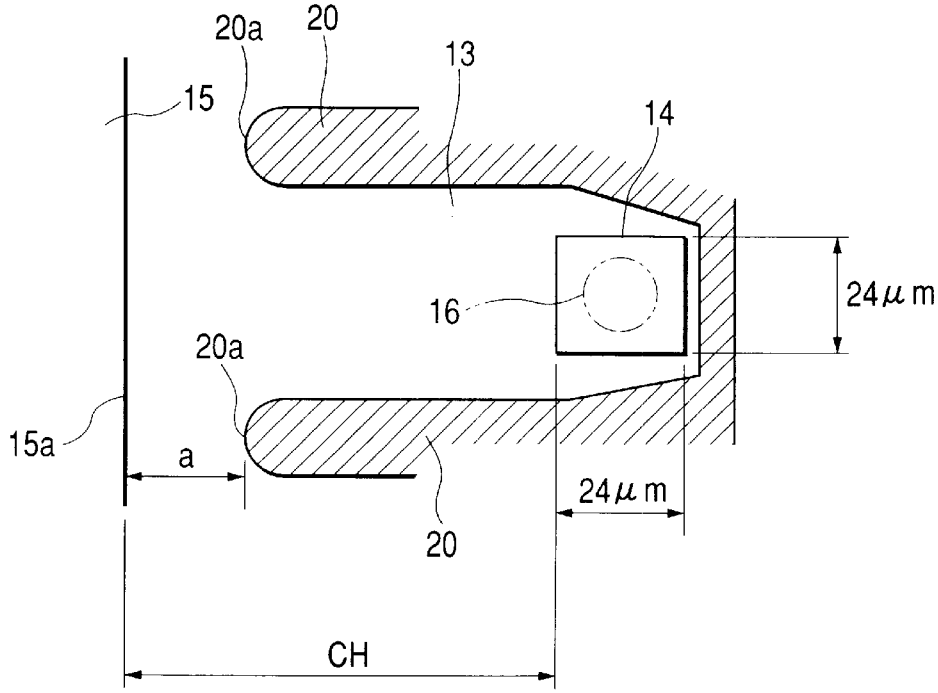
FIG. 4 is a perspective plan view in the vicinity of an electro thermal converting element viewed from the arrow B direction as shown in FIG. 2.

FIG. 1 is an outside perspective view of a recording head cartridge showing a basic configuration for the present embodiment, and FIG. 2 is a typically partial broken perspective view of a recording element substrate for performing the discharge of an ink which is provided in the recording head as shown in FIG. 1. FIG. 3 is a partially broken perspective view of the recording element substrate 12 taken along the 3—3 line in FIG. 2, and FIG. 4 is a perspective plan view in the vicinity of an electro thermal converting element 14 viewed from the arrow B direction of FIG. 2.

As shown in FIG. 1, a recording head cartridge 11 which is detachably mounted on an ink jet recording apparatus 501 to be described later and reciprocate-scanned in the X direction comprises an X jet recording head 516 comprising a recording element substrate 12 in which a plurality of discharge ports 16 for discharging the ink are formed. The recording head cartridge 11 is detachably mounted with an ink tank not shown for supplying the ink to the recording element substrate 12. With respect to the recording head cartridge 11 according tot he present embodiment, the example capable of mounting six ink tanks storing the ink of six colors is shown. Note that, as for the colors of the six ink colors to be stored in the ink tanks, a color ink which is a color other than black and a black ink may be stored.

The discharge port row comprising a plurality of discharge ports 16 formed on the recording element substrate 12 as shown in FIG. 1 is shown where two rows each for each color, that is, a total of twelve rows of the discharge port rows are formed.

As shown in FIG. 2, the recording element substrate 12 has a thin film formed by a Si-substrate 19 having, for example, a thickness of 0.51 mm. Six rows of ink supply ports 15, which supply the ink of their respective colors, comprising a penetration port in a long groove shape are formed and, at both sides of each ink supply port 15, electro thermal converting elements 14 are arranged respectively, one column by one column, in staggered fashion, and the electro thermal converting element 14 and an electric wiring (refer to FIGS. 7A and 7B) such as Al and the like for supplying an electric power to the electro thermal converting element 14 are formed by a film forming technique. In an electrode unit 18 for supplying the electric power to the electric wiring, a bump such as Au and the like is disposed. The ink supply port 15 performs an anisotropic etching by utilizing a crystal orientation of the Si substrate 19. In the case where a crystal orientation of <100> in a wafer surface and <111> in a thickness direction is maintained, an etching proceeds by an alkali system (KOH, TMAH, hydrazine and the like) anisotropic etching. By using this method, the etching is made to a desired depth. Alternatively, the ink supply port 15 may be formed by an AE-POLY system which is disclosed in Japanese Patent Application Laid-Open No. 10-181032. In the case of this AE-POLY system, because the ink supply port 15 can be highly accurately formed, it can reduce the irregularity of the distance CH to be described later and hence it is preferable.

On the Si substrate 19, an ink path wall 20 for forming an ink path 13 corresponding to the electro thermal converting element 14 and the discharge port 16 are formed by a photolithographic technique, and twelve rows of the above described discharge port row 10 corresponding to six colors are formed. Each electro thermal converting element 14 is disposed so as to face each discharge port 16, and a bubble is generated from the ink supplied from the ink supply port 15 by the electro thermal converting element 14 and discharged from the discharge port 16, so that a recording is made on a recording medium such as a recording paper and the like. Note that, when the ink is discharged, the bubble formed on the electro thermal converting element 14 may communicate with the atmosphere through the discharge port 16. It is preferable that the diameter of a dot which the ink discharged from the discharge port 16 at one time forms on the recording medium is equal to or less than 55 μm.

Next, while the dimension and the like of each unit will be described, the following each numerical value shows only one example and it is not intended to be limited to them.

As shown in FIG. 3 and FIG. 4, though each ink path 13 is separated by the ink path wall 20, in the present embodiment, the ink path wall 20 is constituted in such a manner that it is not extended to the ink supply port end portion 15*a*, so that the distance from the ink supply port end portion 15*a* to the ink path wall end portion 20*a* is separated only by a distance a. Although the present embodiment shows a construction where the distance from the ink supply port end portion 15*a* to the ink path wall end portion 20*a* is separated only by the distance a, it is not intended to be limited to this, but the arrangement may be such that the distance a is zero, that is, the ink path wall end portion 20*a* is extended to the ink supply port end portion 15*a*.

With respect to the distance CH from the element end portion 14*a* which is an end portion at the side close to the ink supply port 15 of the electro thermal converting element 14 to the ink supply port end portion 15*a*, when the distance CH from the ink supply port 15 to the electro thermal converting element 14 is equal to or less than 20 μm, a bubble which allows a liquid droplet to be discharged grows much easier at the ink supply port 15 side so that the discharge becomes unstable and hence it is preferable that the distance CH is equal to or more than 20 μm. In the present embodiment, for all the electro thermal converting elements 14, the distance CH is taken as 45.5 μm. The conventional ink jet recording head has such a constitution that there exists the distance CH which is longer than the distance CH of the present embodiment and, for this reason, there was often the case where the viscous plug property become defected. In the present embodiment, however, the distance CH is relatively shorter than the distance CH of the conventional ink jet recording head and yet a uniform distance CH is adopted so that the improvement of the viscous plug property can be attempted. Further, the irregularities of the discharge amount of the ink and the discharge speed between the discharge ports can be controlled.

A height t1 of the ink path 13 is 16 μm, and the distance t2 from the electro thermal converting element 14 to a discharge port side end portion of the discharge port 16, that is, the surface of the recording element substrate 12, is 25 μm.

Figure 5:
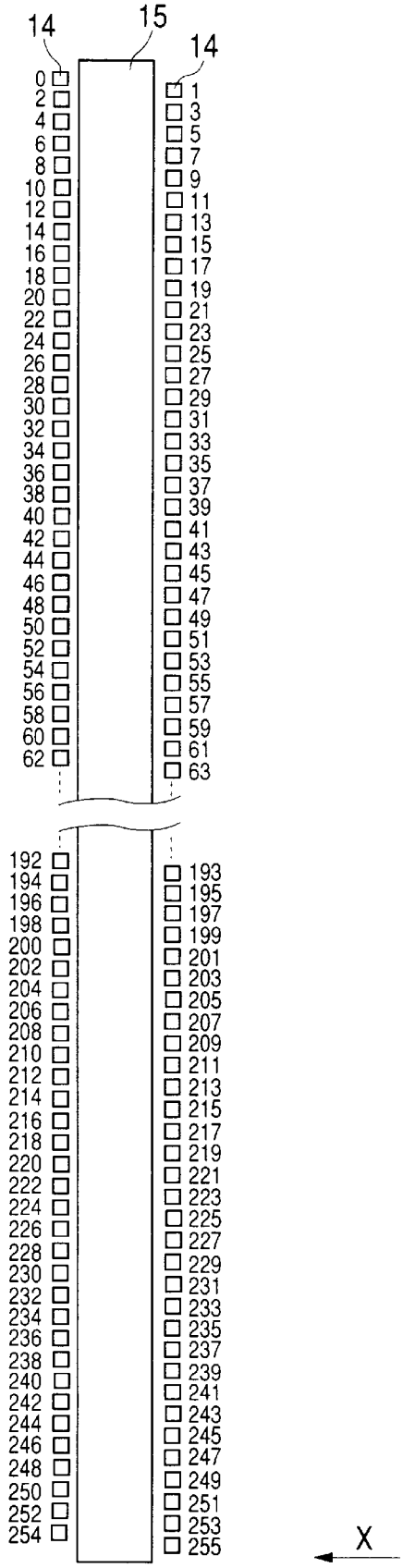
FIG. 5 is a typical plan view showing the arrangement of the electro thermal converting elements in the ink jet recording head of the first embodiment of the present invention.
Figure 6:
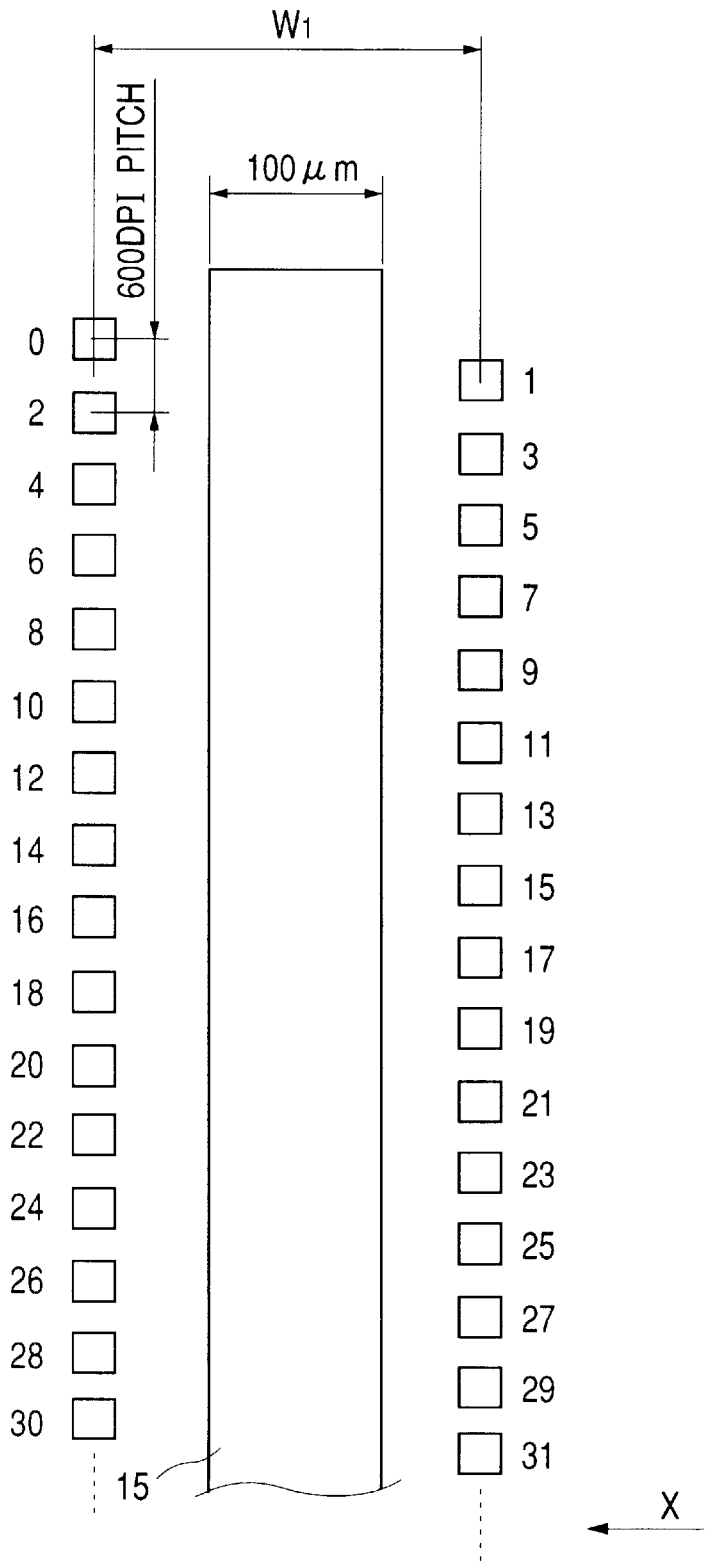
FIG. 6 is a partially enlarged view of FIG. 5.

Next, a typical plan view of the electro thermal converting elements arranged in a straight line on both asides of one ink supply port is shown in FIG. 5, and a partially enlarged view of FIG. 5 is shown in FIG. 6. Note that the figure shown at the side of each electro thermal converting element shows the segment of each electro thermal converting element.

Although the shape of the electro thermal converting element 14 of the present embodiment is, as shown in FIG. 4, a square of 24 μm×24 μm, it is not intended to be limited to this. Regarding this electro thermal converting element 14, a total of 256 pieces (128 pieces for one side) of segments from 0 to 255 of the electro thermal converting elements are arranged on both sides of the longitudinal direction of the ink supply port 15 having a lateral width of 100 μm as shown in FIG. 5 and FIG. 6. These electro thermal converting elements 14 are arranged in a straight line with a pitch of 600 DPI in staggered fashion. The distance W1 between centers of each electro thermal converting element 14 which holds the ink supply port 15 in-between may be 215 μm.

Figure 7A:
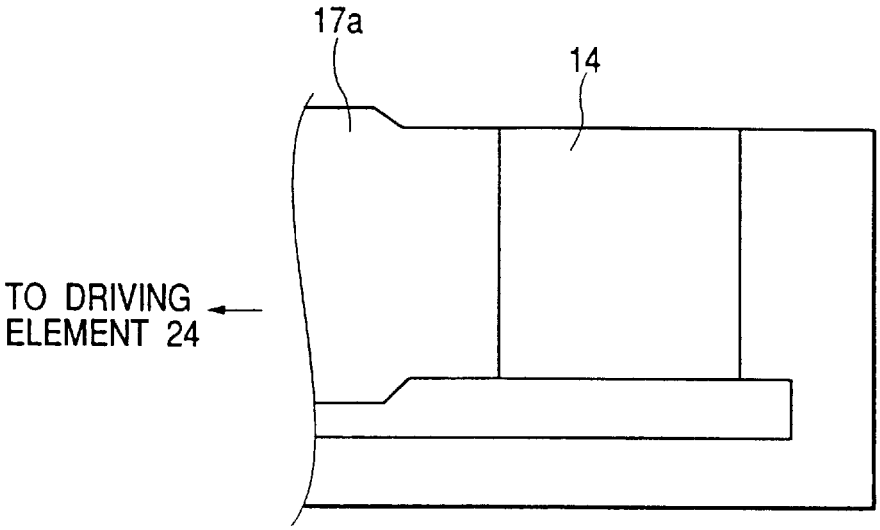
FIGS. 7A and 7B are plan views showing a wiring connected to the electro thermal converting element and a driving circuit diagram of the electro thermal converting element.
Figure 7B:
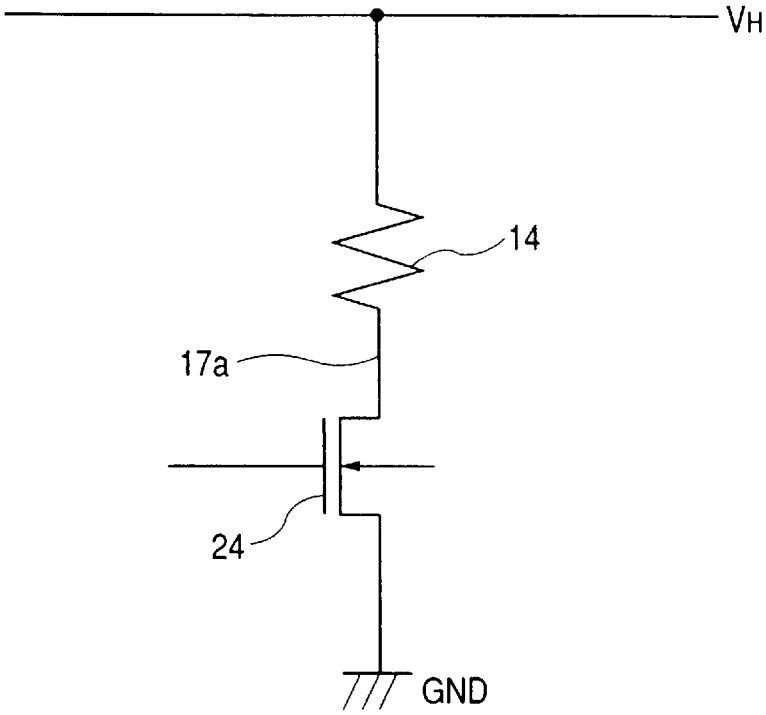

In the present embodiment, by having each electro thermal converting element 14 arranged in a straight line, the distance between the electro thermal converting element 14 and each driving element 24 as shown in FIG. 7A and FIG. 7B which drives each electro thermal converting element 14 can be equally arranged respectively. For this reason, each wiring 17*a* for electrically connecting each electro thermal converting element 14 and each driving element 24 has an equal length, respectively. That is, because the wiring resistance of all the wiring 17*a* can be made equal, a uniform electric power can be applied to the electro thermal converting element 14 without being governed by the wiring resistance of the wiring 17*a*. Hence, there is no need to apply more electric power than required and a durability of the electro thermal converting element 14 can be improved.

Figure 8:
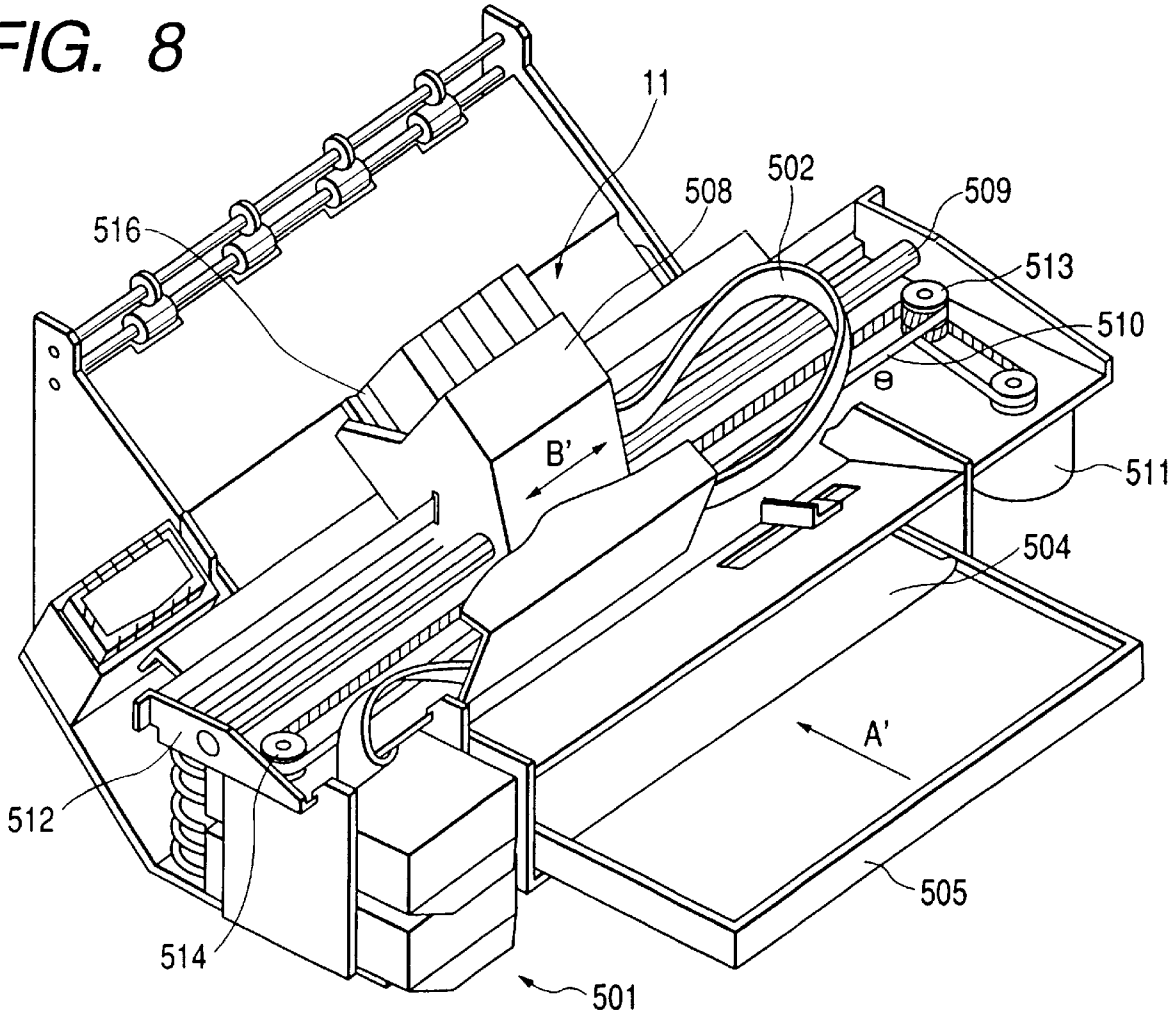
FIG. 8 is a perspective view of an ink jet recording apparatus in the first embodiment of the present invention.

Next, a perspective view of the ink jet recording apparatus capable of mounting the ink jet recording head of the present embodiment is shown in FIG. 8.

A guide shaft 509 is attached to a main body chassis 512, and a carriage 508 is slidably supported by the guide shaft 509 in the arrow B' direction. This carriage 508 is partially fixed to a timing belt 510 which is stretched between a driving pulley 513 combined with a driving motor 511 and an idler pulley 514 and capable of reciprocating in the arrow B' direction along the guide shaft 509 in response to the rotation of the driving motor. The discharge port 16 of the recording head cartridge 11 comprising the ink jet recording head 516 is formed downward as shown and performs a recording on a recording sheet 504 which is a recording medium by discharging the ink from the discharge port 16. The recording sheet 504 is fed from a supply tray 505 in the arrow A' direction.

Figure 9:
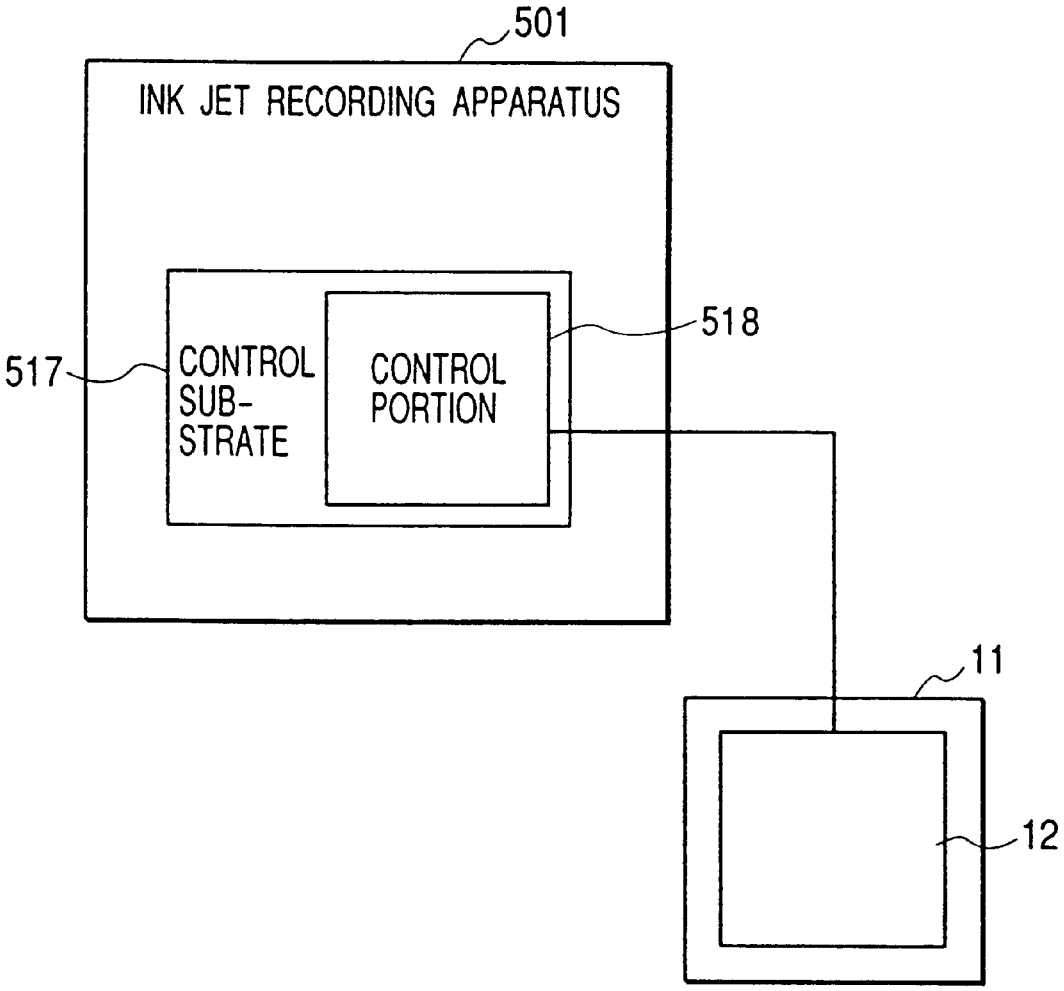
FIG. 9 is a block diagram explaining a control portion.

The recording head cartridge 11 is detachably attachably mounted on the carriage 508 and is electrically connected to a control substrate 517 which is a substrate for controlling a recording apparatus main body attached to the rear face of the main body chassis 512 through a flexile cable 502 which receives and transmits an electric current and a signal for driving this recording head cartridge 11. A control portion 518 for controlling the driving sequence of the electro thermal converting element 14 of the recording element substrate 12 as shown in the block diagram of FIG. 9 is disposed on this control substrate 517.

Figure 10:
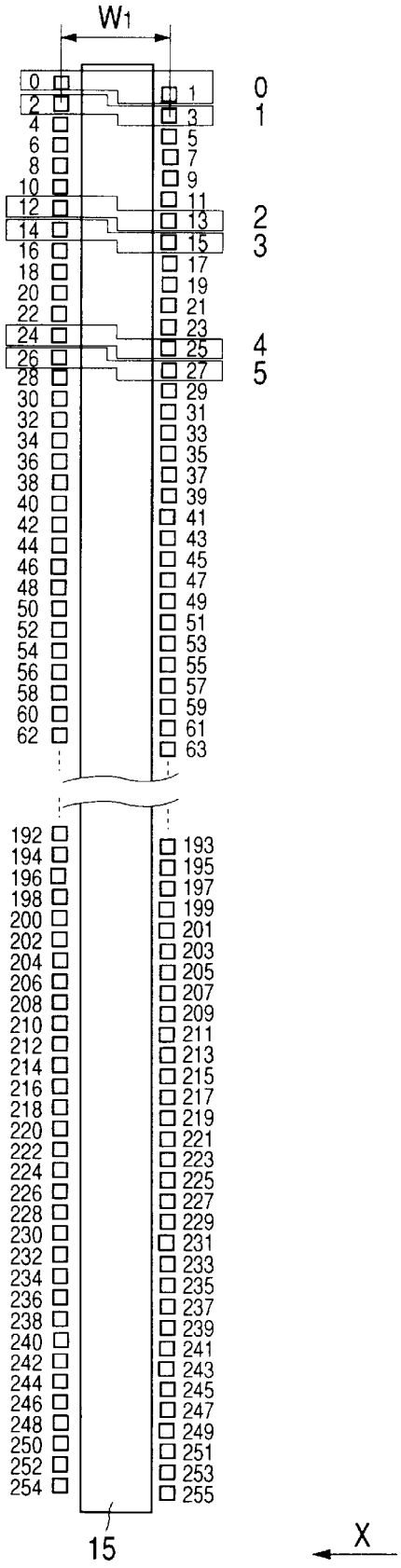
FIG. 10 is a view explaining a block separation by a disperse driving of the first embodiment of the present invention.

Next, the driving system of each electro thermal converting element 14 by the control portion 518 will be described with reference to FIG. 10 and Table 3.

TABLE 3

| Segment | Block sequence |
|---|---|
| 0 | 0 |
| 1 | 0 |
| 2 | 1 |
| 3 | 1 |
| 4 | 6 |
| 5 | 6 |
| 6 | 7 |
| 7 | 7 |
| 8 | 12 |
| 9 | 12 |
| 10 | 13 |
| 11 | 13 |
| 12 | 2 |
| 13 | 2 |
| 14 | 3 |
| 15 | 3 |
| 16 | 8 |
| 17 | 8 |
| 18 | 9 |
| 19 | 9 |
| 20 | 14 |
| 21 | 14 |
| 22 | 15 |
| 23 | 15 |
| 24 | 4 |
| 25 | 4 |
| 26 | 5 |
| 27 | 5 |
| 28 | 10 |
| 29 | 10 |
| 30 | 11 |
| 31 | 11 |

(The following segments are a repetition of the above described sequence.)

Electro thermal converting elements 14 of the segments from 0 to 255 are separated into blocks which group the electro thermal converting elements 14 which generate heat almost at the same time.

For example, regarding each electro thermal converting element 14 of the segments from 0 to 31, the electro thermal converting element 14 of the segment 0 and the electro thermal converting element 14 of the segment 1 are separated into a block 0 and the electro thermal converting element 14 of the segment 2 and the electro thermal converting element 14 of the segment 3 are separated into a block 1, so that they are separated into a total of 16 blocks. In FIG. 10, the blocks from 0 to 5 are shown. That is, this block separation is made in such a manner that the electro thermal converting elements 14 adjacent in the direction arranged almost in a straight line are separated into blocks so as not to be included in the same blocks and it is capable of performing a so-called disperse-driving by the control portion 518. For example, the segment 0 and the segment 2 which are arranged at the left side of the ink supply port 15 are separated so that they do not generate heat at the same time.

Note that what is here referred to as "almost" of "almost at the same time" means a deviation in a discharge timing which takes into a consideration a moving speed of the ink jet recording head 516 and the distance W1 between centers of each electro thermal converting element 14. For example, in the block 0, the segment 0 and the segment 1 are disposed by being separated by the distance W1 between centers, and the ink jet recording head 516 moves at an established moving speed when recording. Thus, the segment 0 and the segment 1 do not generate heat completely at the same time, but are allowed to generate heat with a slight deviation in the discharge timing which takes into consideration the moving speed of the ink jet recording head 516 and the distance W1 between centers of each electro thermal converting element 14. Hence, it does not mean "at the same time", but "almost at the same time".

Because the discharge volume of the ink is slightly different for each block, if the adjacent electro thermal converting element 14 is included in the same block, a recording irregularity sometimes occurs. However, if the adjacent electro thermal converting element 14 is included in different block similar to the present embodiment and, further, the disperse-driving similar to the present embodiment is performed, it is possible to reduce the recording irregularity.

The difference of the timing for each block, for example, a block interval which is a time interval between the block 0 and the block 1 until the block 1 which is to be driven subsequently to the block 0 which has been driven is driven is 2.1 $\mu$s. This block interval is, for example, controlled by the control portion 518 in such a manner that it is almost equal between any blocks from 0 to 15 in the segments from 0 to 31. Further, a deviation in the main scanning direction of a dot center inside one column is about 17 $\mu$m. In the present embodiment, the block interval is driven so that it comes as close as possible to a value of (40/16) $\mu$s. Naturally, if the block interval is made shorter, the deviation in the main scanning direction of the dot center inside one column can be made smaller. However, as the time for not performing the discharge inside one column becomes longer and a vibration is generated inside a head, the interval is driven by allowing it to come close to (40/16) $\mu$s.

The ink jet recording head 516 constituted as above performs a recording at a 1200 DPI pitch by being scanned in the X direction. It can be driven at a driving frequency of 25 kHz and a discharge is performed at one discharge port 16 for every shortest time interval of about 40 $\mu$s. In this way, because the ink jet recording head 516 of the present embodiment has the same distance CH for any of the electro thermal converting element 14, the irregularity of the driving frequency can be eliminated. Further, an ink jet recording apparatus 501 of the present embodiment can raise the driving frequency because the distance CH longer than necessary does not exist and, hence, the time from performing the discharge to refilling the ink can be made shorter so that a high speed recording can be realized.

The discharge liquid droplet volume discharged from one discharge port 16 of the ink jet recording head 516 of the present embodiment is equal to or less than 9 pl which is the amount smaller than the usual discharge liquid droplet volume discharged from the conventional ink jet recording head. For this reason, the displacement deviation caused when each electro thermal converting element 14 is aligned in a straight line can be allowed not to be detected visually. Furthermore, by using the ink which is lower in the density of color materials than the usual ink, it is effective even when the detection of the displacement deviation itself is visually difficult to detect.

As described above, according to the ink jet recording head and the ink jet recording apparatus of the present invention, because the distance CH is a uniform length, the improvement of the driving frequency, the lowering of the recording irregularity, the improvement of the durability and the improvement of the viscous plug properties can all be attempted.

Second Embodiment

Next, the disperse driving by the control portion of the ink jet recording apparatus of the present embodiment will be described with reference to FIG. 11 and Table 4. Note that the ink jet recording head and the ink jet recording apparatus of the present embodiment are basically the same as the ink jet recording head and the ink jet recording apparatus described in the first embodiment except that the disperse driving system to be described below is different and therefore the detailed description thereof will be omitted.

TABLE 4

| | Block Sequence | |
|---|---|---|
| Segment | Even | Odd |
| 0 | 0 | — |
| 1 | — | 11 |
| 2 | 3 | — |
| 3 | — | 14 |
| 4 | 6 | — |
| 5 | — | 1 |
| 6 | 9 | — |
| 7 | — | 4 |
| 8 | 12 | — |
| 9 | — | 7 |
| 10 | 15 | — |
| 11 | — | 10 |
| 12 | 2 | — |
| 13 | — | 13 |
| 14 | 5 | — |
| 15 | — | 0 |
| 16 | 8 | — |
| 17 | — | 3 |
| 18 | 11 | — |
| 19 | — | 6 |
| 20 | 14 | — |
| 21 | — | 9 |
| 22 | 1 | — |
| 23 | — | 12 |
| 24 | 4 | — |
| 25 | — | 15 |
| 26 | 7 | — |
| 27 | — | 2 |
| 28 | 10 | — |
| 29 | — | 5 |
| 30 | 13 | — |
| 31 | 0 | 8 |

(The following segments are a repetition of the above described sequence.)

In the case of the present embodiment, though each electro thermal converting element 114 of the segments from 0 to 31 is separated into 16 pieces of the blocks similarly to the first embodiment, a combination of the electro thermal converting elements 114 constituting each block is different from the first embodiment.

That is, the block separation of the present embodiment is such that the electro thermal converting elements 114 adjacent to the direction where the electro thermal converting elements 114 are arranged almost in a straight line are not contained in the same block and that the electro thermal converting element 114 which has been driven and the electro thermal converting element 114 of the block which is to be a driven subsequently to the block which has been driven is not to be in its vicinity and, further, the block separation is made in such a manner that the electro thermal converting elements 114 adjacent by holding the ink supply port 115 in-between are not contained.

The relationship of the above described block separation will be concretely described with reference to FIG. 11.

Although the segment 0 of the block 0 and the segment 2 of the block 2 are the electro thermal converting elements adjacent to the direction arranged almost in a straight line, because they belong to a different block, they do not generate heat at the same time, respectively.

Further, right after the block 0 is driven, the electro thermal converting element 114 of the block 1 generates heat. However, neither a segment 5 nor a segment 22, both of which belong to the block 1, comes to the vicinity of the segment 0 and a segment 15, both of which belong to the block 0.

Further, in the block 0, the segment 0 and the segment 15 have no relationship to be in the vicinity by holding the ink supply port 115 in-between.

In the present embodiment, by making the block separation as described above, the discharge is performed according to the sequence of the blocks.

Figure 11:
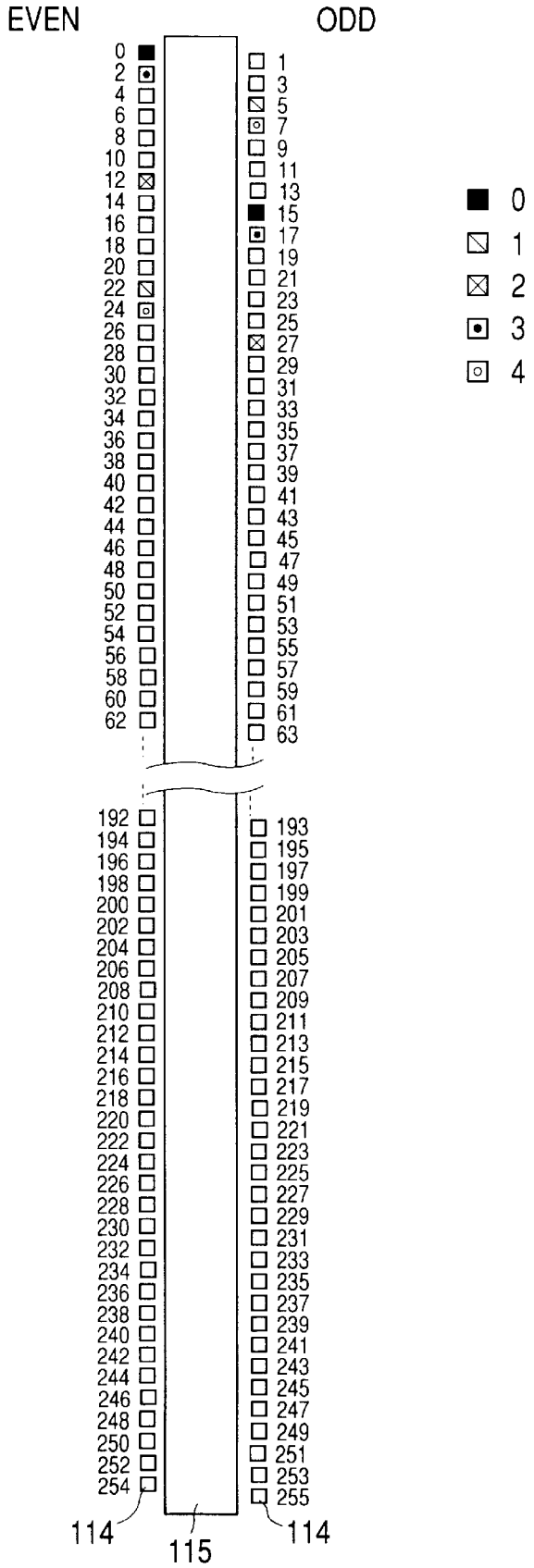
FIG. 11 is a view explaining the block separation by a disperse driving of a second embodiment of the present invention.

Note that, in FIG. 11 and Table 4, the electro thermal converting element 114 at the left side of the ink supply port 215 is shown as an EVEN side and the electro thermal converting element 114 at the right side as an ODD side.

As described above, by being separated into the blocks and drivingly controlled, the recording irregularity caused by the constitution where the adjacent electro thermal converting elements are contained in the same block can be reduced.

As described above, according to the ink jet recording head and the ink jet recording apparatus of the present embodiment, because the distance CH is a uniform length similarly to the first embodiment, the improvement of the driving frequency, the lowering of the recording irregularity, the improvement of the durability and, furthermore, the reliability of the viscous plug properties could be attempted.

Third Embodiment

Figure 12:
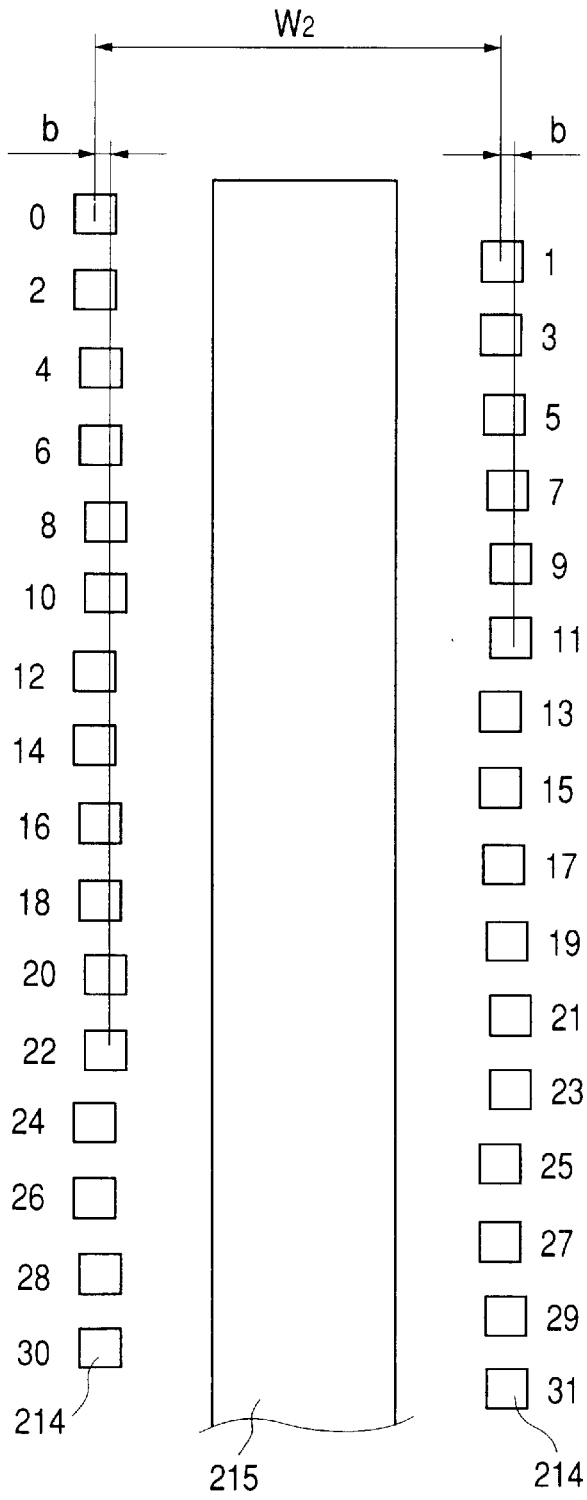
FIG. 12 is a view showing the arrangement of the electro thermal converting element of a third embodiment of the present invention.

Next, a partially extended typical plan view of the electro thermal converting elements arranged in a straight line at both sides of the ink supply port of the present embodiment is shown in FIG. 12.

As shown in FIG. 12, Table 5 and Table 6, the electro thermal converting element 214 of the present embodiment is basically the same as the first embodiment and the second embodiment except that it is arranged in an almost straight line having the maximum width of 9 $\mu$m of the deviation b in the X direction and the distance W2 between centers of each electro thermal converting element 214 with the ink supply port 215 held in-between is 245 $\mu$m. Therefore, the description of the details thereof will be omitted. Note that, though the deviation b in the X direction is shown as having the maximum 9 $\mu$m as an example in FIG. 12, Table 5 and Table 6, it may have the maximum 10 $\mu$m. That is, the central line toward the longitudinal direction of the ink supply port 215 of each electro thermal converting element 214 may exist within a width of 10 $\mu$m or the difference of the distance CH may be within 10 $\mu$m.

TABLE 5

| Segment | Deviation in X direction |
|---|---|
| 0 | 0 |
| 2 | 0.5 |
| 4 | 3.5 |
| 6 | 4.25 |
| 8 | 7.25 |
| 10 | 7.75 |
| 12 | 1.25 |
| 14 | 1.75 |
| 16 | 4.75 |
| 18 | 5.5 |
| 20 | 8.5 |
| 22 | 9 |

TABLE 5-continued

| Segment | Deviation in X direction |
|---|---|
| 24 | 2.25 |
| 26 | 3 |
| 28 | 6 |
| 30 | 6.75 |

(The even number segments are a repetition of the above described sequence in the following segments.)

TABLE 6

| Segment | Deviation in X direction |
|---|---|
| 1 | 0 |
| 3 | 0.5 |
| 5 | 3.5 |
| 7 | 4.25 |
| 9 | 7.25 |
| 11 | 7.75 |
| 13 | 1.25 |
| 15 | 1.75 |
| 17 | 4.75 |
| 19 | 5.5 |
| 21 | 8.5 |
| 23 | 9 |
| 25 | 2.25 |
| 27 | 3 |
| 29 | 6 |
| 31 | 6.75 |

(The odd number segments are a repetition of the above described sequence in the following segments.)

In the case of the present embodiment, though the electro thermal converting elements are not arranged in a straight line as with the electro thermal converting elements 14 and 114 of the first and the second embodiments, the value of the above described deviation b in the X direction having 9 $\mu$m or 10 $\mu$m is a numerical value of a pitch equivalent to 2400 DPI being one half of 21.2 $\mu$m which is a pitch of 1200 DPI. For this reason, even though the electro thermal converting elements 214 are not arranged in a straight line, because the deviation b in the X direction is slight, they are in a state of being arranged in an almost straight line, and the ink jet recording head of the present embodiment can also obtain the same effect as the effect of the first and the second embodiments obtained by the electro thermal converting elements 14 and 114 being arranged in a straight line.

That is, because the ink jet recording head and the ink jet recording apparatus of the present embodiment also have the distance CH of the uniform length similarly to the first and the second embodiments, the improvement of the driving frequency, the lowering of the recording irregularity, the improvement of the durability and the improvement of the viscous plug property may also be attempted.

Note that, while the present invention has described one example of the embodiment, it is not limited to this and the above described numerical values as shown in each embodiment are illustrative and not intended to be limited to them. Furthermore, though the examples of the above described each embodiment will be shown below, the present invention is not intended to be limited to any one of them.

First Example

By using the ink jet recording head described in the first embodiment, the present example recorded various recording patterns based on various types of recording media, recording resolutions and discharge liquid droplet sizes.

The recording condition and the observation condition of the present example are shown below.

TABLE 7

| Driving method | Disperse Driving shown in Table 3 |
|---|---|
| Deviation b in X direction [$\mu$m] | 0 |
| Distance W between centers [$\mu$m] | 215 |
| Driving frequency [kHz] | 25 |
| Element shape [$\mu$m × $\mu$m] | 24 × 24 |
| Liquid path height $t_1$ [$\mu$m], distance $t_2$ [$\mu$m] | 25, 16 |
| Scanning direction resolution [DPI] | 1200 |
| CH distance [$\mu$m] | 45.5 |
| Recording pattern | 1 dot vertical ruled line, 2 dots vertical ruled line, 4 dots vertical ruled line |
| Recording color | Bk, C, M, Y |
| Recording medium | HR-101 |
| Dot size [$\mu$m] | 40 to 50 |
| Maximum distance between centers of dots [$\mu$m] | 9.9, 19.8, 29.8, 39.7, 59.5 |
| Observation distance [cm] | 20 |

By the above described condition, the ink discharge was made and a study as to whether a displacement deviation at a longitudinal ruled line can be recognized when viewed from a distance of 20 cm was made by the judgment of five subjects who are not related to the development of the image and the like.

First Comparative Example

Figure 13:
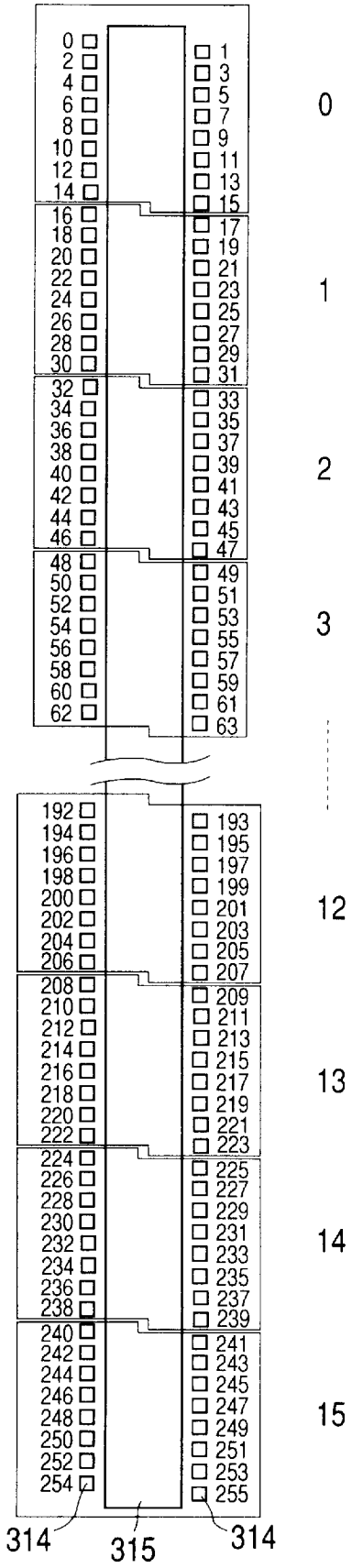
FIG. 13 is a view explaining the block separation by the block driving of a first comparative example.

As a first comparative example, the driving method only of the electro thermal converting element was changed from the disperse driving to a so-called block driving as shown in FIG. 13 and Table 8, and otherwise with the same condition as with the first example, a recording of various recording patterns was made based on various types of recording media, recording resolutions and discharge liquid droplet sizes.

TABLE 8

| Segment | Block sequence |
|---|---|
| 0 to 15 | 0 |
| 16 to 31 | 1 |
| 32 to 47 | 2 |
| 48 to 63 | 3 |
| 64 to 79 | 4 |
| 80 to 95 | 5 |
| 96 to 111 | 6 |
| 112 to 127 | 7 |
| 128 to 143 | 8 |
| 144 to 159 | 9 |
| 160 to 175 | 10 |
| 176 to 191 | 11 |
| 192 to 207 | 12 |
| 208 to 223 | 13 |
| 224 to 239 | 14 |
| 240 to 255 | 15 |

What is referred to as the block driving, which is used by the present comparative example, is that each electro thermal converting element 314 of the segment from 0 to 255 is separated into 16 pieces of blocks. For example, each electro thermal converting element 314 of the segment from 0 to 15 is taken as a block 0, and each electro thermal converting element 314 of segments 16 to 31 is separated into a block 1. That is, the block separation is made in such a manner that adjacent electro thermal converting elements 314 generate heat at the same time and, further, the electro thermal converting element 314 of the block which has been driven and the electro thermal converting element 314 to be driven subsequently to the block which has been driven are in the vicinity.

Second Comparative Example

Figure 19:
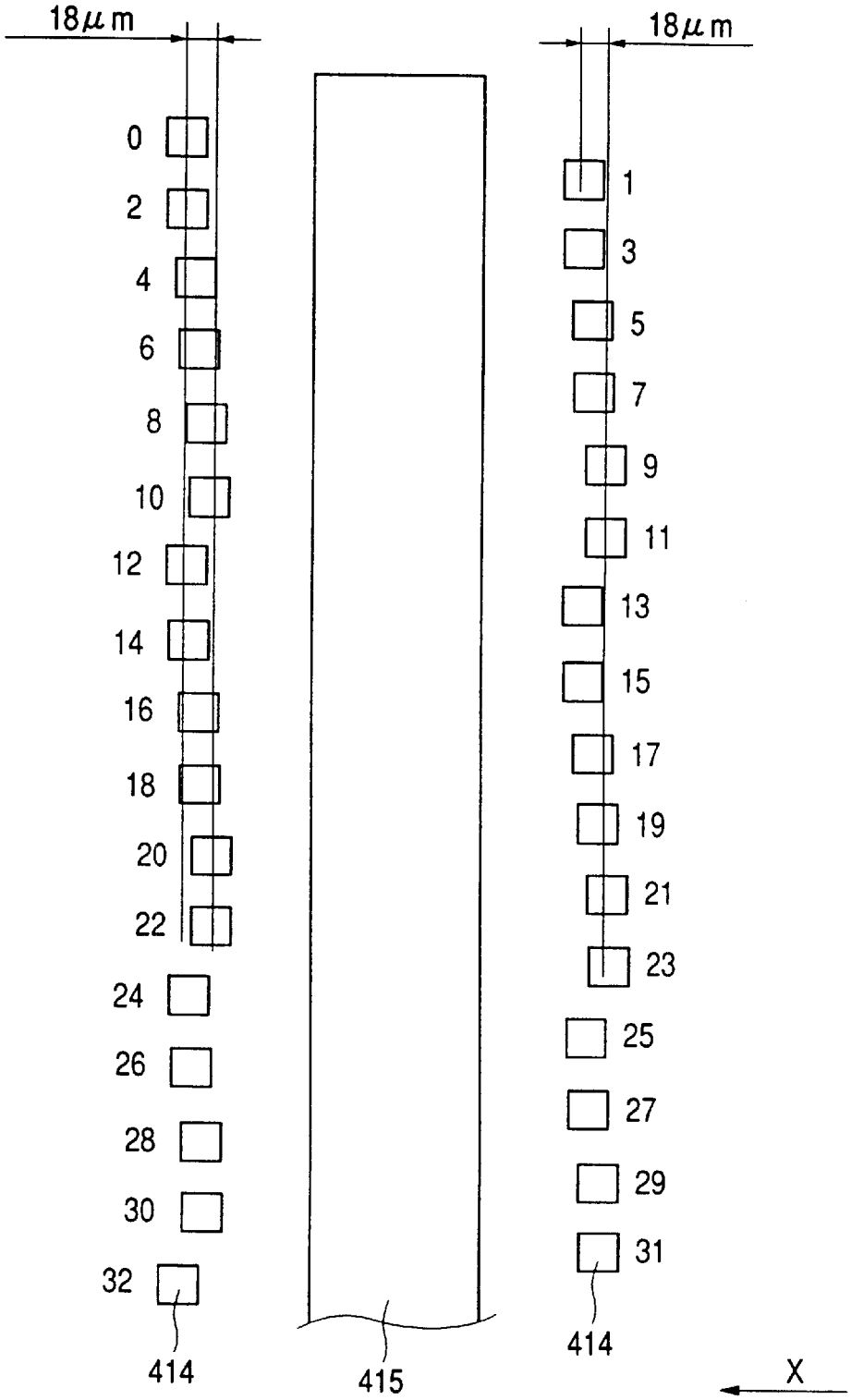
FIG. 19 PRIOR ART
FIG. 19 is a typical plan view showing one example of the arrangements of the electro thermal converting elements in the conventional ink jet recording head.

As a second comparative example, by using the conventional ink jet recording head as shown in FIG. 19 and a recording of various recording patterns was made in the same way as the first example based on various types of recording media, recording resolutions and discharge liquid droplet sizes.

The recording condition and the observation condition of the present comparative example are shown below.

TABLE 9

| Driving method | Disperse Driving shown in Table 3 |
|---|---|
| Deviation b in X direction [μm] | 18 |
| Distance between centers W [μm] | 215 + 18 (= 233) |
| Driving frequency [kHz] | 15 |
| Element shape [μm × μm] | 24 × 24 |
| Liquid path height $t_1$ [μm], distance $t_2$ [μm] | 25, 16 |
| Scanning direction resolution [DPI] | 1200 |
| CH distance [μm] | 45.5 to 63.5 |
| Recording pattern | 1 dot vertical ruled line, 2 dots vertical ruled line, 4 dots vertical ruled line |
| Recording color | Bk, C, M, Y |
| Recording medium | HR-101 |
| Dot size [μm] | 40 to 50 |
| Maximum distance between centers of dots [μm] | 9.9, 19.8, 29.8, 39.7, 59.5 |
| Observation distance [cm] | 20 |

The results obtained by the first example, the first and the second comparative examples performed under the above described condition are shown below.

Figure 16:
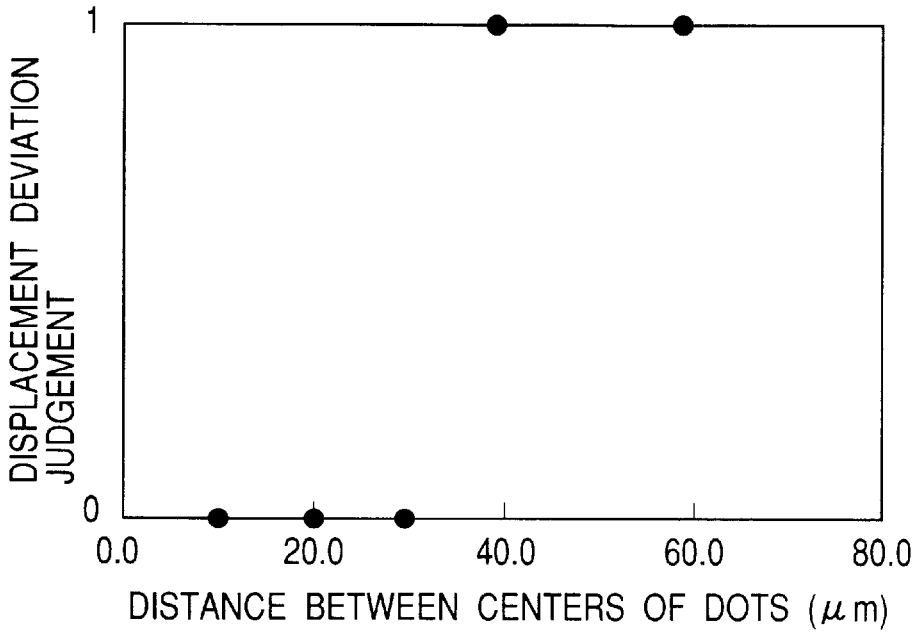
FIG. 16 is a view showing the state of the displacement in the joint between scanning in the case of the block driving obtained in the first comparative example.

The judgment result of the displacement deviation obtained in the first example is shown in FIG. 16. Note that in FIG. 16 the judgment result of the ink of Bk only is shown. Also, in FIG. 16, the one recognized as the displacement deviation is shown as 1 and the one not recognized as 0.

As shown in FIG. 16, in the case of Bk where the maximum distance between centers of dots is 39.7, 59.5 μm, the displacement deviation was recognized, but in the case of the maximum distance between centers of dots is 9.9, 19.8, 29.8 μm, no displacement deviation was recognized. On the other hand, though not shown, in the case of the colors C, M, Y, no displacement deviation was recognized even when the distance was 39.7 μm. In this way, because the maximum distance between centers of dots=29.8 μm is equivalent to about 800 DPI, in the case of the pitch which is smaller than 800 DPI, it became evident that a recording having an accuracy to the extent that no displacement deviation due to the disperse driving irrespective of ink colors is allowed to be recognized is possible.

Figure 14:
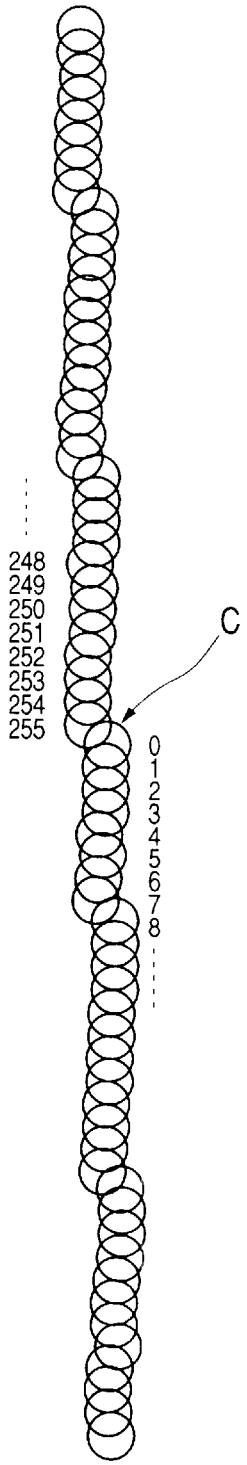
FIG. 14 is a graph showing a judgment result of a displacement deviation obtained in the first example of the present invention.
Figure 15:
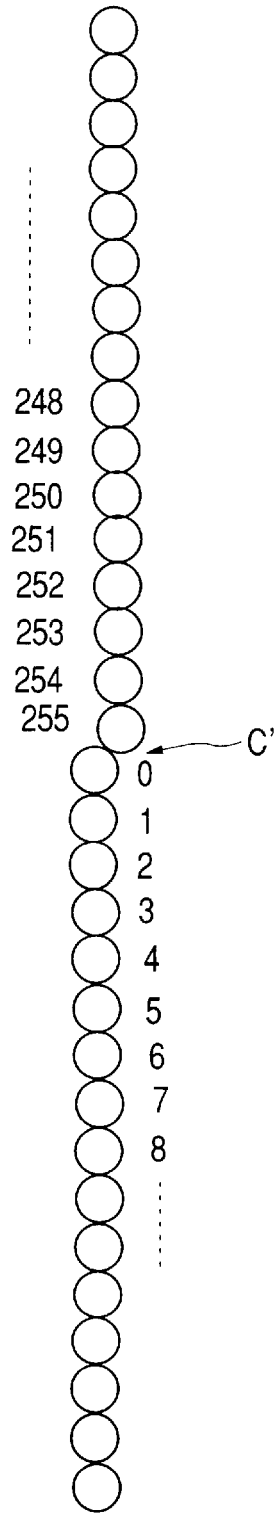
FIG. 15 is a view showing a state of the displacement in the joint between scanning in the case of the disperse driving obtained in the first example of the present invention.

Next, a view showing a state of the displacement in the joint between the scannings by the first example is shown in FIG. 14 and a view showing a state of the displacement in the joint between the scannings by the first comparative example is shown in FIG. 15, respectively. That is, the displacement deviation due to the difference between the disperse driving used in the first example and the block driving used in the first comparative example is shown in FIG. 14 and FIG. 15.

In the case of the block driving, as shown in FIG. 15, it was recognized that, due to the displacement deviation in the joint C' between the scannings, a linearity of the ruled line was lost. On the other hand, in the case of the disperse driving, as shown in FIG. 14, it was recognized that no clear displacement deviation is recognized in the joint C between the scannings and the linearity of the ruled line is secured.

Figure 18:
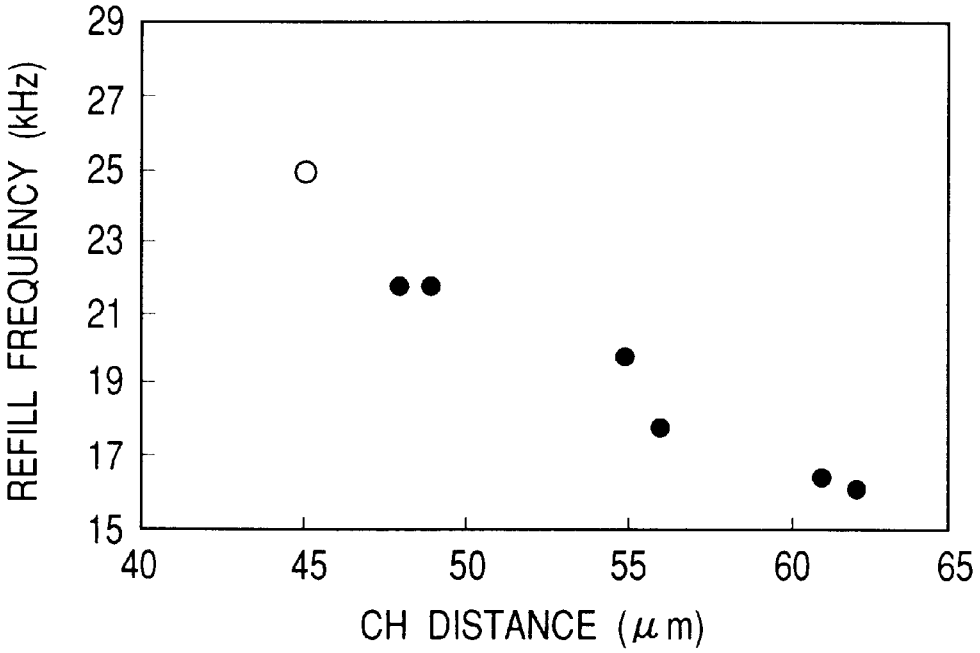
FIG. 18 is a graph showing the relationship between the ink discharge amount from each discharge port and a distance CH.

Next, the frequency characteristic of a refill obtained by the first example and the second comparative example is shown in FIG. 18. A white circle mark of FIG. 18 shows a measurement value by the first example and a black circle mark shows the measurement value by the second comparative example.

The driving frequency of the second comparative example is decided by the longest distance CH. That is, because the driving frequency of the second comparative example has the distance CH within 45.5 to 63.5 μm, the distance CH is influenced by the longest 63.5 μm so as to be 15 kHz and therefore it is not a adequate for a high speed recording.

On the other hand, in the case of the first example, because the distance CH is 45.5 μm and constant, the driving frequency becomes 24 kHz and constant and also can be driven at a high frequency, and therefore it became clear that the time from performing the discharge to refilling the ink is shortened and high speed recording is the result.

Further, when the viscous plug property which is a time for normally recording a first shot was measured under the environment of 15° C./10%, even with respect to this viscous plug property, in the case of the first example as shown in Table 10, because the distance CH is constant and, further, it is not influenced by the long distance CH in the same way as the second comparative example, it is three seconds for the second comparative example, while it is five seconds for the first example and thus the improvement of the viscous plug property was recognized.

TABLE 10

| | First example | Second comparative example |
|---|---|---|
| Viscous plug property (second) | 5 | 3 |

Figure 17:
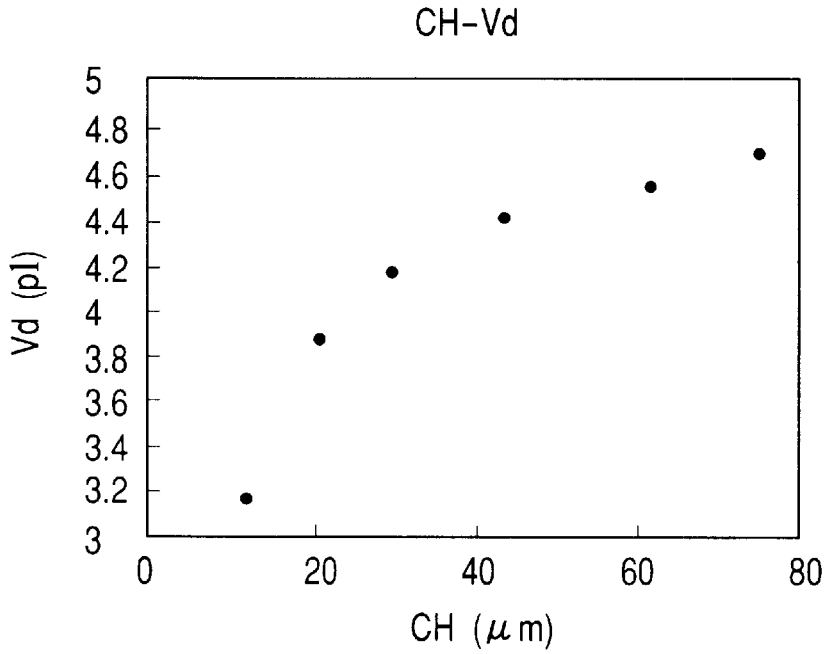
FIG. 17 is a view showing a refill frequency characteristic.

Next, in the ink jet recording head of the first example, by changing the distance CH from 12 μm to 62 μm, the result of observing a generation limit of the diminished dot which is an ink discharge defect is shown in FIG. 17 and Table 11.

TABLE 11

| CH distance (μm) | Diminished dot |
|---|---|
| 12 | Diminished dot |
| 21 | No diminished dot |
| 30 | No diminished dot |
| 44 | No diminished dot |
| 62 | No diminished dot |

When the distance CH is equal to or less than 20 μm, the discharge amount is reduced and the diminished dot is sometimes produced, but when the distance CH is equal to or less than 20 μm, the diminished dot is not produced and it became clear that a good discharge characteristic can be obtained.

Second Example

In the present example, by using the disperse driving described in the second embodiment of FIG. 11 and Table 4, a recording of various recording patterns was performed based on various types of recording media, the recording resolutions and the discharge liquid droplet sizes.

The recording condition and the observation condition of the present example are shown below.

TABLE 12

| Driving method | Disperse Driving shown in Table 4 |
|---|---|
| Deviation b in X direction [μm] | 0 |
| Distance between centers W [μm] | 215 |
| Driving frequency [kHz] | 25 |
| Element shape [μm × μm] | 24 × 24 |
| Liquid path height $t_1$ [μm], distance $t_2$ [μm] | 25, 16 |
| Scanning direction resolution [DPI] | 600 |
| CH distance [μm] | 45.5 |
| Recording pattern | 1 dot vertical ruled line, 2 dots vertical ruled line, 4 dots vertical ruled line |
| Recording color | Bk, C, M, Y |
| Recording medium | HR-101 |
| Dot size [μm] | 40 to 50 |
| Maximum distance between centers of dots [μm] | 9.9, 19.8, 29.8, 39.7, 59.5 |
| Observation distance [cm] | 20 |

In the present example, in the case of the ink of Bk where the maximum distance between centers of dots is 59.5 μm, the displacement deviation was recognized, but in the case where the maximum distance between centers of dots is 9.9, 19.8, 29.8, 39.7 μm, no displacement deviation was recognized. Also in the case of the ink of C, M, Y, similarly to the Bk, no displacement deviation was recognized except when the distance was 59.5 μm. In this way, because the maximum distance between centers of dots=39.7 μm is equivalent to about 600 DPI, in the case of the pitch which is smaller than 600 DPI, it became clear that a recording having an accuracy to the extent that no displacement deviation due to the disperse driving irrespective of ink colors is allowed to be recognized is possible.

In addition, in the present example, similarly to the result of the first example, no clear displacement deviation was recognized in the joint between the scannings, but securing the linearity of the ruled line was recognized. The frequency characteristic was improved and the viscous plug property was secured for five seconds.

Third Example

In the present example, by using the ink jet recording head having the deviation b in the X direction of 9 μm, which has been described in the third embodiment, a recording of various recording patterns was performed based on various types of recording media, recording resolutions and discharge liquid droplet sizes.

The recording condition and the observation condition of the present example are shown below.

TABLE 13

| Driving method | Dispense Driving shown in Table 3 |
|---|---|
| Deviation b in X direction [μm] | 9 |
| Distance between centers W [μm] | 245 |
| Driving frequency [kHz] | 20 |
| Element shape [μm × μm] | 24 × 24 |
| Liquid path height $t_1$ [μm], distance $t_2$ [μm] | 25, 16 |
| Scanning direction resolution [DPI] | 1200 |
| CH distance [μm] | 45.5 to 54.5 |
| Recording pattern | 1 dot vertical ruled line, 2 dots vertical ruled line, 4 dots vertical ruled line |

TABLE 13-continued

| Driving method | Dispense Driving shown in Table 3 |
|---|---|
| Recording color | Bk, C, M, Y |
| Recording medium | HR-101 |
| Dot size [μm] | 40 to 50 |
| Maximum distance between centers of dots [μm] | 9.9, 19.8, 29.8, 39.7, 59.5 |
| Observation distance [cm] | 20 |

In the case of the present example, as shown in Table 14, though the viscous plug property became one second shorter than in the first and second examples, it was recognized that it could be secured for one second longer than the second comparative example.

TABLE 14

| | Third example | Second comparative example |
|---|---|---|
| Viscous plug property (second) | 4 | 3 |

Further, though the frequency characteristic was also reduced to 20 kHz, which was 5 kHz less than the first and the second examples, it was recognized that the deviation b in the X direction is 18 μm, that is, better than the second comparative example which is equivalent to 1200 DPI.

In addition, in the present example, regarding the displacement deviation, a good result was obtained in the same way as the result of the first example and, further, it was recognized that no clear displacement deviation is recognized in the joint between the scannings and the linearity of the ruled line is secured.

What is claimed is:

1. An ink jet recording method using an ink jet recording head comprising an ink supply port for supplying an ink, a plurality of ink paths communicating with the ink supply port, a plurality of electrothermal converting elements arranged in an almost straight line along the longitudinal direction of the ink supply port and disposed respectively in the plurality of ink paths to generate thermal energy utilized for discharging the ink, and a plurality of discharge ports which communicate with the plurality of ink paths, respectively, and are disposed respectively facing the plurality of electrothermal converting elements for discharging the ink, said method comprising the step of:

performing recording by driving the plurality of electrothermal converting elements in a dispersed manner, wherein an ink discharge amount discharged from each discharge port at one time is equal to or less than 9 pl.

2. An ink jet recording apparatus comprising:

an ink jet recording head comprising an ink supply port for supplying an ink, a plurality of ink paths communicating with said ink supply port, a plurality of electrothermal converting elements arranged in an almost straight line along the longitudinal direction of said ink supply port and disposed respectively in said plurality of ink paths to generate thermal energy utilized for discharging the ink, and a plurality of discharge ports which communicate with said plurality of ink paths, respectively, and are disposed respectively facing said plurality of electrothermal converting elements for discharging the ink; and a control portion for driving said plurality of electrothermal converting elements in a dispersed manner, wherein the distance from said ink supply port to the end portion of each of said plurality of electrothermal converting elements at the side closer to the ink supply port is equal to or more than 20 μm, respectively.

3. The ink jet recording apparatus according to claim 2, wherein the lengths of wirings for electrically connecting a plurality of driving elements for applying electric power to said plurality of electrothermal converting elements and said plurality of electrothermal converting elements, respectively, are almost the same.

4. The ink jet recording apparatus according to claim 2, wherein a side wall of each ink path is not formed until the end of said ink supply port.

5. The ink jet recording apparatus according to claim 2, wherein a density of the recording performed by said ink jet recording head is equal to or more than 1200 dpi.

6. The ink jet recording apparatus according to claim 2, wherein an arrangement density of the plurality of electrothermal converting elements arranged in the almost straight line is equal to or more than 600 dpi.

7. The ink jet recording apparatus according to claim 2, wherein a bubble formed by the thermal energy generated by one of said electrothermal converting elements is discharged by being in communication with ambience through a corresponding discharge port.

8. The ink jet recording apparatus according to claim 2, wherein said ink supply port is formed by an AE-POLY system.

9. An ink jet recording apparatus comprising:

an ink jet recording head comprising an ink supply port for supplying an ink, a plurality of ink paths communicating with said ink supply port, a plurality of electrothermal converting elements arranged in an almost straight line along the longitudinal direction of said ink supply port and disposed respectively in said plurality of ink paths to generate thermal energy utilized for discharging the ink, and a plurality of discharge ports which communicate with said plurality of ink paths, respectively, and are disposed respectively facing said plurality of electrothermal converting elements for discharging the ink; and a control portion for driving said plurality of electrothermal converting elements in a dispersed manner, wherein an ink discharge amount discharged from each discharge port at one time is equal to or less than 9 pl.

10. The ink jet recording apparatus according to claim 9, wherein a bubble formed by the thermal energy generated by one of said electrothermal converting elements is discharged by being in communication with ambience through a corresponding discharge port.

11. An ink jet recording apparatus comprising:

an ink jet recording head comprising an ink supply port for supplying an ink, a plurality of ink paths communicating with said ink supply port, a plurality of electrothermal converting elements arranged in an almost straight line along the longitudinal direction of said ink supply port and disposed respectively in said plurality of ink paths to generate thermal energy utilized for discharging the ink, and a plurality of discharge ports which communicate with said plurality of ink paths, respectively, and are disposed respectively facing said plurality of electrothermal converting elements for discharging the ink; and a control portion for driving said plurality of electrothermal converting elements in a dispersed manner, wherein the size of a dot formed on the recording medium by the ink discharged from each discharge port at one time is equal to or less than 55 μm.

12. The ink jet recording apparatus according to claim 11, wherein a bubble formed by the thermal energy generated by one of said electrothermal converting elements is discharged by being in communication with ambience through a corresponding discharge port.

13. An ink jet recording apparatus comprising:

an ink jet recording head comprising an ink supply port for supplying an ink, a plurality of ink paths communicating with said ink supply port, a plurality of electrothermal converting elements arranged in an almost straight line along the longitudinal direction of said ink supply port and disposed respectively in said plurality of ink paths to generate thermal energy utilized for discharging the ink, and a plurality of discharge ports which communicate with said plurality of ink paths, respectively, and are disposed respectively facing said plurality of electrothermal converting elements for discharging the ink; and a control portion for driving said plurality of electrothermal converting elements in a dispersed manner, wherein a central line of each of said plurality of electrothermal converting elements along the longitudinal direction of said ink supply port exists within a width along the longitudinal direction of said ink supply port of 10 μm.

14. The ink jet recording apparatus according to claim 13, wherein a bubble formed by the thermal energy generated by one of said electrothermal converting elements is discharged by being in communication with ambience through a corresponding discharge port.

15. The ink jet recording apparatus according to claim 13, wherein the lengths of wirings for electrically connecting a plurality of driving elements for applying electric power to said plurality of electrothermal converting elements and said plurality of electrothermal converting elements, respectively, are almost the same.

16. The ink jet recording apparatus according to claim 13, wherein a side wall of each ink path is not formed until the end of said ink supply port.

17. The ink jet recording apparatus according to claim 13, wherein a density of the recording performed by said ink jet recording head is equal to or more than 1200 dpi.

18. The ink jet recording apparatus according to claim 13, wherein an arrangement density of the plurality of electrothermal converting elements arranged in the almost straight line is equal to or more than 600 dpi.

19. The ink jet recording apparatus according to claim 13, wherein said ink supply port is formed by an AE-POLY system.

20. An ink jet recording method using an ink jet recording head comprising an ink supply port for supplying an ink, a plurality of ink paths communicating with the ink supply port, a plurality of electrothermal converting elements arranged in an almost straight line along the longitudinal direction of the ink supply port and disposed respectively in the plurality of ink paths to generate thermal energy utilized for discharging the ink, and a plurality of discharge ports which communicate with the plurality of ink paths, respectively, and are disposed respectively facing the plurality of electrothermal converting elements for discharging the ink, said method comprising the step of:

performing recording by driving the plurality of electrothermal converting elements in a dispersed manner, wherein the size of a dot formed on the recording medium by the ink discharged from each discharge port at one time is equal to or less than 55 μm.

* * * * *

UNITED STATES PATENT AND TRADEMARK OFFICE

CERTIFICATE OF CORRECTION

PATENT NO. : 6,557,982 B2
DATED : May 6, 2003
INVENTOR(S) : Murakami et al.

It is certified that error appears in the above-identified patent and that said Letters Patent is hereby corrected as shown below:

Column 6,
Line 30, “tot he” should read -- to the --.

Column 7,
Line 63, “asides” should read -- sides --.

Column 16,
Line 16, “a” (first occurrence) should be deleted.

Signed and Sealed this

Eleventh Day of November, 2003

JAMES E. ROGAN
*Director of the United States Patent and Trademark Office*